US009417029B1

(12) United States Patent
Chang

(10) Patent No.: US 9,417,029 B1
(45) Date of Patent: Aug. 16, 2016

(54) ARROW SHAFT PRESSING DEVICE FOR CROSSBOW

(71) Applicant: Eldwin Chang, Taichung (TW)

(72) Inventor: Eldwin Chang, Taichung (TW)

(73) Assignee: POE LANG ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 14/820,531

(22) Filed: Aug. 6, 2015

(51) Int. Cl.
*F41B 5/12* (2006.01)
*F41B 5/14* (2006.01)

(52) U.S. Cl.
CPC . *F41B 5/12* (2013.01); *F41B 5/143* (2013.01); *F41B 5/1469* (2013.01)

(58) Field of Classification Search
CPC ..... F41B 5/12; F41B 5/143; F41B 5/1469
USPC ..... 124/25, 86
See application file for complete search history.

(56) References Cited

U.S. PATENT DOCUMENTS 2,520,713 A * 8/1950 Diehr ..... F41B 5/12 124/25
3,739,765 A * 6/1973 Moore ..... F41B 5/126 124/25
3,788,299 A * 1/1974 Mathews ..... F41B 5/12 124/25
4,030,473 A * 6/1977 Puryear ..... F41B 5/1469 124/25
4,688,539 A * 8/1987 Lawrence ..... F41B 5/1469 124/25.6
4,827,893 A * 5/1989 Nishioka ..... F41B 5/12 124/22
5,062,406 A * 11/1991 Robertson ..... F41B 5/12 124/22
5,598,829 A * 2/1997 Bednar ..... F41A 17/28 124/25
5,884,614 A * 3/1999 Darlington ..... F41B 5/1469 124/25
6,868,845 B1 * 3/2005 Moore ..... F41B 5/126 124/25
7,455,059 B2 * 11/2008 Shaffer ..... F41B 5/123 124/25
7,588,022 B2 * 9/2009 Chang ..... F41B 5/123 124/25
7,814,894 B2 * 10/2010 Giroux ..... F41B 5/12 124/25
8,662,061 B1 * 3/2014 Darlington ..... F41B 5/12 124/25
8,857,420 B2 * 10/2014 Grace ..... F41B 5/123 124/25
8,931,465 B1 * 1/2015 Choma ..... F41B 5/12 124/25
8,978,634 B2 * 3/2015 Darlington ..... F41B 5/12 124/25
9,255,755 B1 * 2/2016 Barnett ..... F41B 5/143
2013/0098343 A1 * 4/2013 Grace ..... F41B 5/123 124/25
2014/0174419 A1 * 6/2014 McPherson ..... F41A 17/46 124/35.1
2016/0178310 A1 * 6/2016 Barnett ..... F41B 5/14 124/88

* cited by examiner

*Primary Examiner* — Alexander Niconovich

(57) ABSTRACT

An arrow shaft pressing device for a crossbow includes a sleeve connected to one end of the aiming device and has a passage with an aperture defined through the lower end of the sleeve. A shoulder is formed at the connection portion between the passage and the aperture. A pressing member has a flange and a shank extending from the underside of the flange. The pressing member is located in the passage of the sleeve and the distal end of the shank extends beyond the aperture. A restriction member is connected to the top end of the sleeve. A resilient member is biased between the flange of the pressing member and the restriction member. The distal end of the shank of the pressing member resiliently presses the arrow shaft.

6 Claims, 7 Drawing Sheets

ARROW SHAFT PRESSING DEVICE FOR CROSSBOW

BACKGROUND OF THE INVENTION

1. Fields of the Invention

The present invention relates to a crossbow, and more particularly, to an arrow shaft pressing device for a crossbow.

2. Descriptions of Related Art

The conventional crossbow is disclosed in FIGS. 5 to 7, and comprises a body 5 with a stock 62 connected thereto. The body 5 has a groove 63 defined in a top thereof. A shooting device 64 is connected to the body 6. An aiming device 65 is connected to the shooting device 64 and located above the groove 63. A pressing plate 66 is connected to the aiming device 65 and has a pressing end 661 which extends toward the groove 63.

As shown in FIG. 7, when the string is pulled and engaged with the shooting device 64, and an arrow shaft "A" is installed in the groove 63, the pressing end 661 of the pressing plate 66 presses the shaft of the arrow "A" until the user operates the shooting device 64 to shoot the arrow "A". However, the pressing plate 66 tends to reach its point of elastic fatigue after frequent uses.

The pressing plate 66 is fixed to the aiming device 65 by a bolt 662 which is connected to the aiming device 65 from the underside of the aiming device 65. Because the space between the groove 63 and the aiming device 65 is so narrow that the screwdriver cannot be operated easily, so that the aiming device 65 has to be removed from the body 6 as shown in FIG. 6, such that the pressing plate 66 can be replaced. This is inconvenient for the users.

The present invention intends to provide an arrow shaft pressing device for a crossbow to eliminate the shortcomings mentioned above.

SUMMARY OF THE INVENTION

The present invention relates to an arrow shaft pressing device for a crossbow which has an aiming device connected to a body of the crossbow. The arrow shaft pressing device comprises a sleeve connected to one end of the aiming device and the sleeve has a passage defined axially therein. An aperture is defined through the lower end of the sleeve and co-axially communicates with the passage. A shoulder is formed at the connection portion between the passage and the aperture. A pressing member has a flange and a shank which extends from the underside of the flange. The pressing member is located in the passage of the sleeve and the distal end of the shank extends beyond the aperture. A restriction member is connected to the inside of the top end of the sleeve. A resilient member IS located in the passage and biased between the flange of the pressing member and the restriction member. The distal end of the shank of the pressing member resiliently presses the arrow shaft Preferably, the cross sectional area of the flange of the pressing member is larger than that of the shank.

Preferably, the inside of the top end of the sleeve has inner threads, and the restriction member has outer threads which are threadedly connected to the inner threads of the sleeve.

Preferably, the distal end of the shank of the pressing member has a pressing portion which is a curved surface.

Preferably, the top end of the sleeve is connected to the aiming device by way of threading, snapping, engagement or locking.

Preferably, the sleeve has outer threads formed on the outside of the top end thereof. A stop extends radially from the outside of the sleeve and located below the outer threads of the sleeve. The outer threads of the sleeve are connected to a threaded hole of the aiming device, and the stop is in contact with the underside of the aiming device.

The primary object of the present invention is to provide an arrow shaft pressing device for a crossbow, and the pressing member is easily replaced without detaching the aiming device.

Another object of the present invention is to provide an arrow shaft pressing device for a crossbow, wherein the pressing member is biased by a resilient member which is able to be individually replaced without detaching the aiming device.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
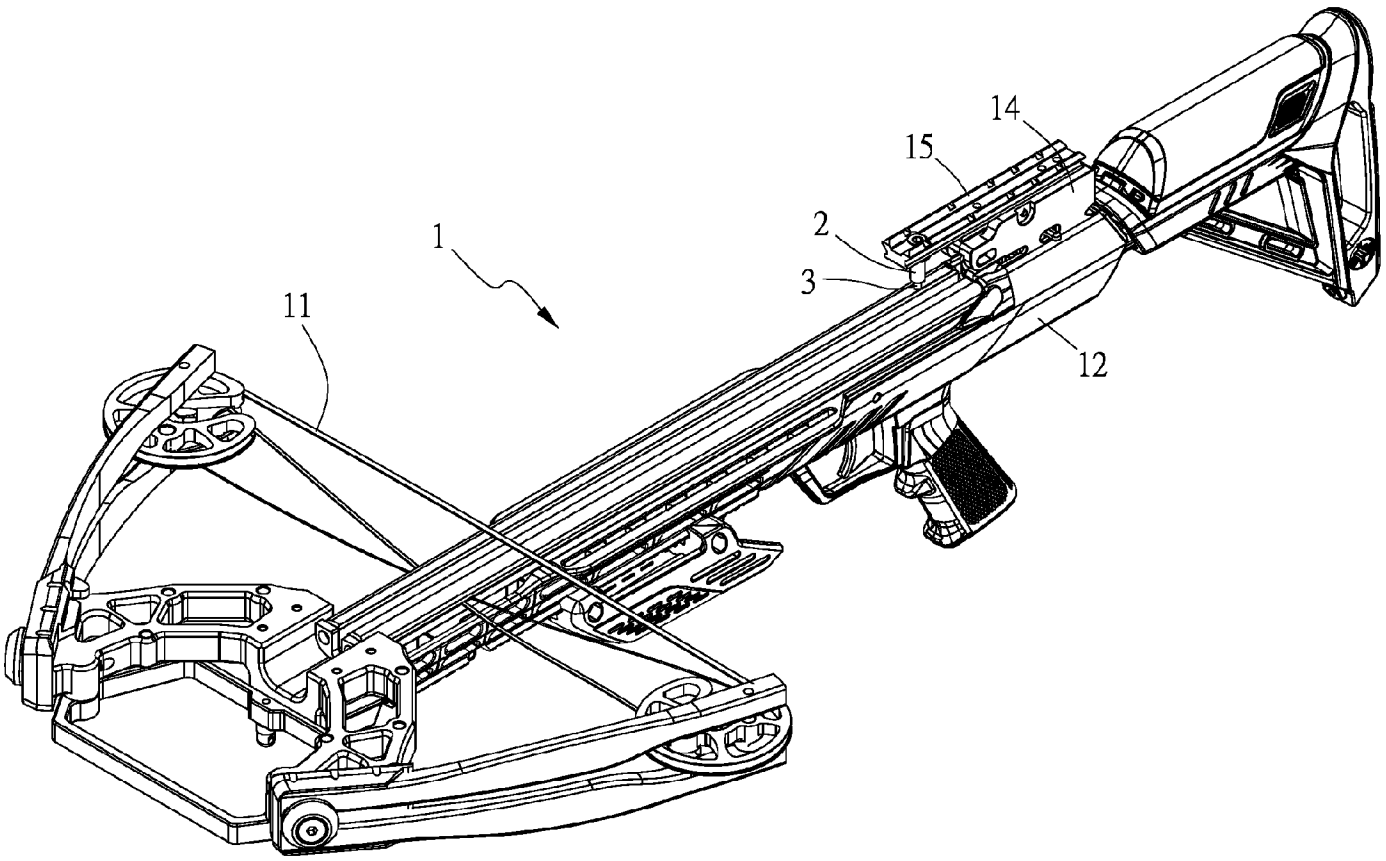
FIG. 1 shows a crossbow with the arrow shaft pressing device of the present invention.
Figure 2:
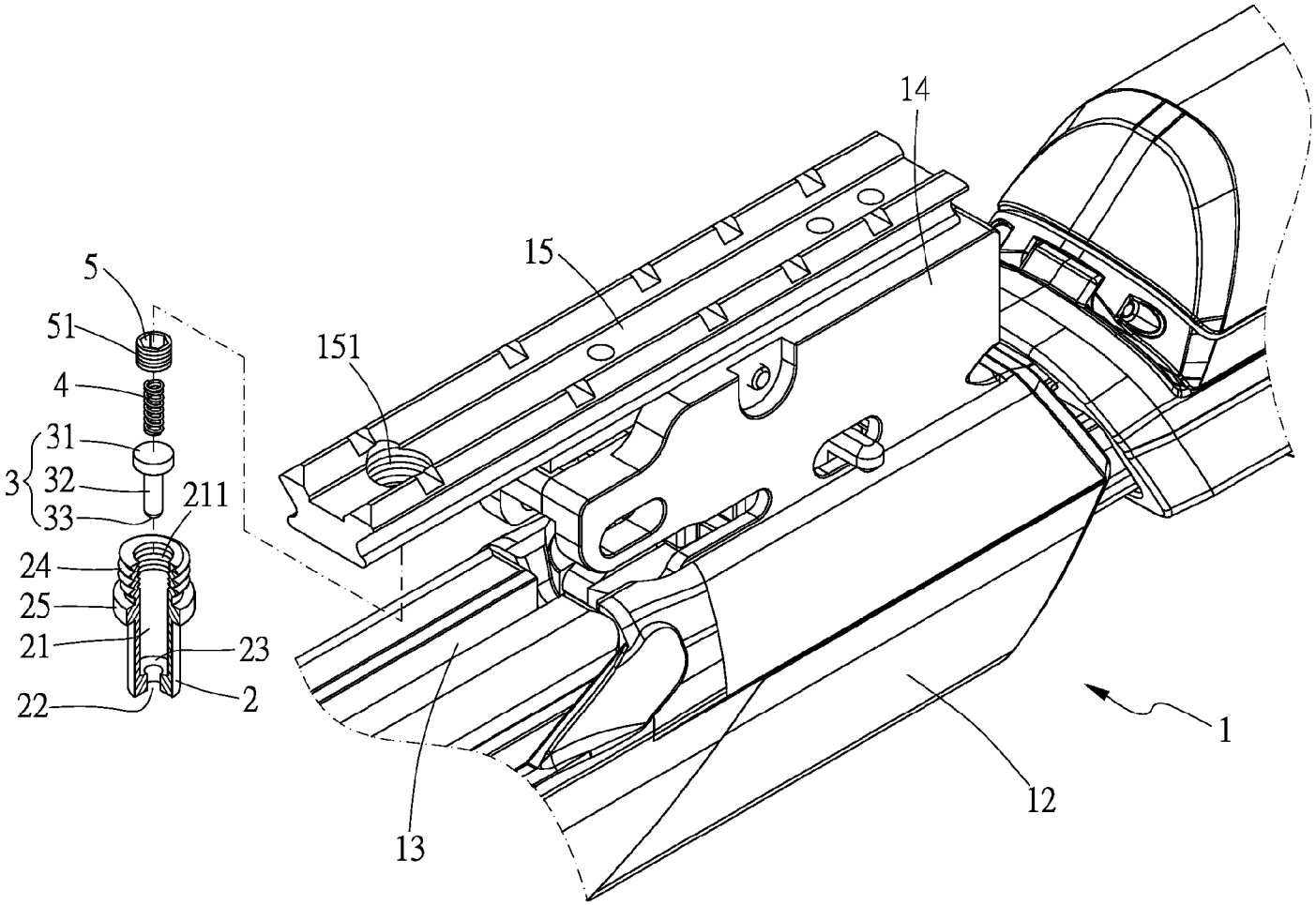
FIG. 2 is an exploded view of the arrow shaft pressing device of the present invention and a portion of the crossbow.

Referring to FIGS. 1 to 4, a crossbow generally comprises a body 1 and a bow is connected to the front end of the body 1. A string 11 is connected to two cam wheels on two limbs of the bow. A stock 12 is connected to the rear end of the body 1 and has a groove 13 defined in the top thereof. A shooting device 14 is connected to the body 1. An aiming device 15 is connected to the shooting device 14 and located above the groove 13. An arrow shaft "A" is installed in the groove 13 to be shot.

The arrow shaft pressing device of the present invention comprises a sleeve 2 which is connected to one end of the aiming device 15 of the body 1 of the crossbow. The sleeve 2 has a passage 21 defined axially therein, and an aperture 22 is defined through the lower end of the sleeve 2 and co-axially communicates with the passage 21. The diameter of the aperture 22 is smaller than that of the passage 21 so as to form a shoulder 23 at the connection portion between the passage 21 and the aperture 22. The sleeve 2 has outer threads 24 formed on the outside of the top end thereof. A stop 25 extends radially from the outside of the sleeve 2 and is located below the outer threads 24 of the sleeve 2. The outer threads 24 of the sleeve 2 are connected to a threaded hole 151 defined through one end of the aiming device 15, and the stop 25 is in contact with the underside of the aiming device 15. The top end of the sleeve 2 can be connected to the aiming device 15 by way of threading, snapping, engagement or locking. The inside of the top end of the sleeve 2 has inner threads 211.

A pressing member 3 has a flange 31 and a shank 32 which extends from the underside of the flange 31. The cross sectional area of the flange 31 of the pressing member 3 is larger than that of the shank 32. The pressing member 3 is located in the passage 21 of the sleeve 2 and the distal end of the shank 32 extends beyond the aperture 22. The distal end of the shank 32 of the pressing member 3 has a pressing portion 33 which is a curved surface.

A restriction member 5 has outer threads 51 which are threadedly connected to the inner threads 211 of the sleeve 2. A resilient member 4 is located in the passage 21 and biased between the flange 31 of the pressing member 3 and the restriction member 5. The distal end of the shank 32 of the pressing member 3 extends beyond the aperture 22 of the sleeve 2 so as to resilient press the arrow shaft "A" in the groove 13 of the crossbow.

Figure 3:
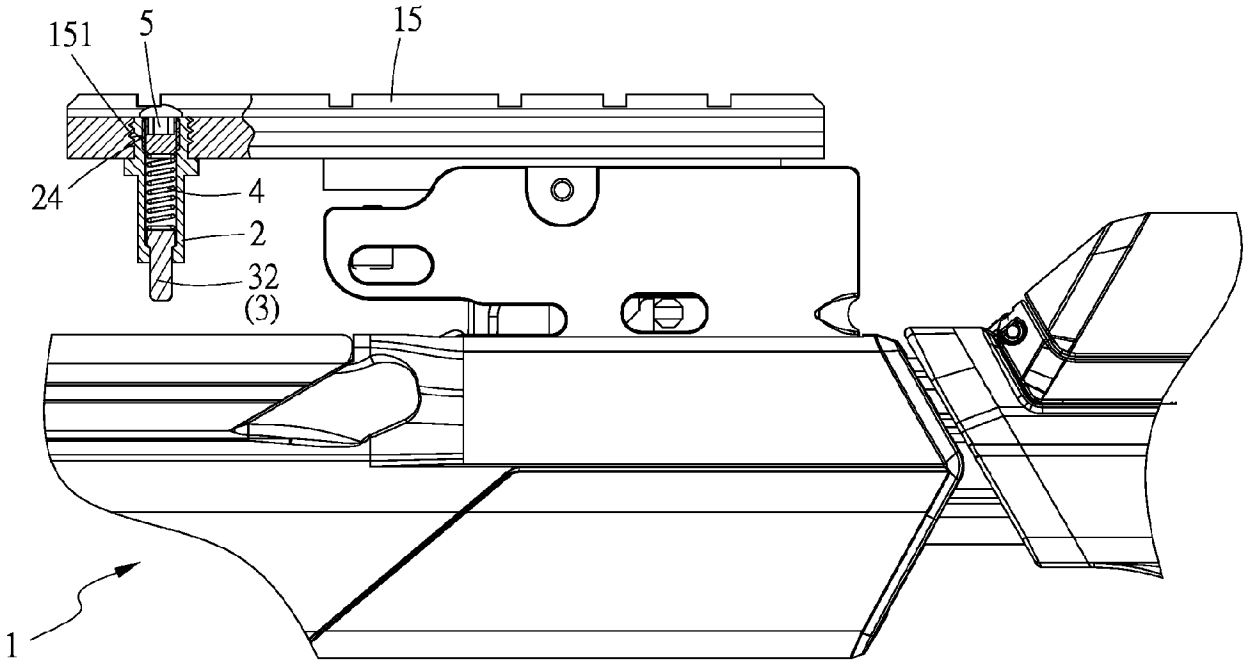
FIG. 3 is a cross sectional view of the arrow shaft pressing device of the present invention installed to the crossbow.
Figure 4:
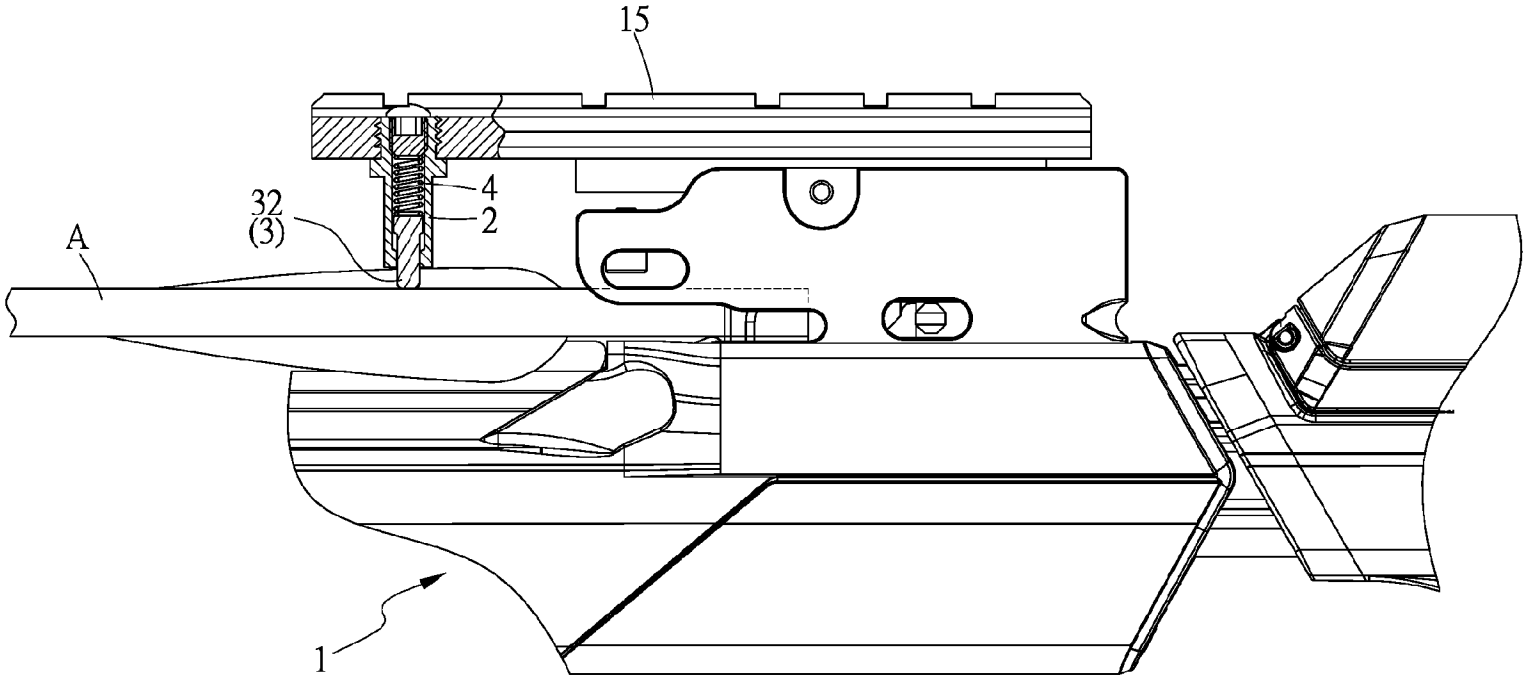
FIG. 4 is a cross sectional view of the arrow shaft pressing device of the present invention wherein the arrow shaft is pressed by the pressing member of the arrow shaft pressing device of the present invention.
Figure 5:
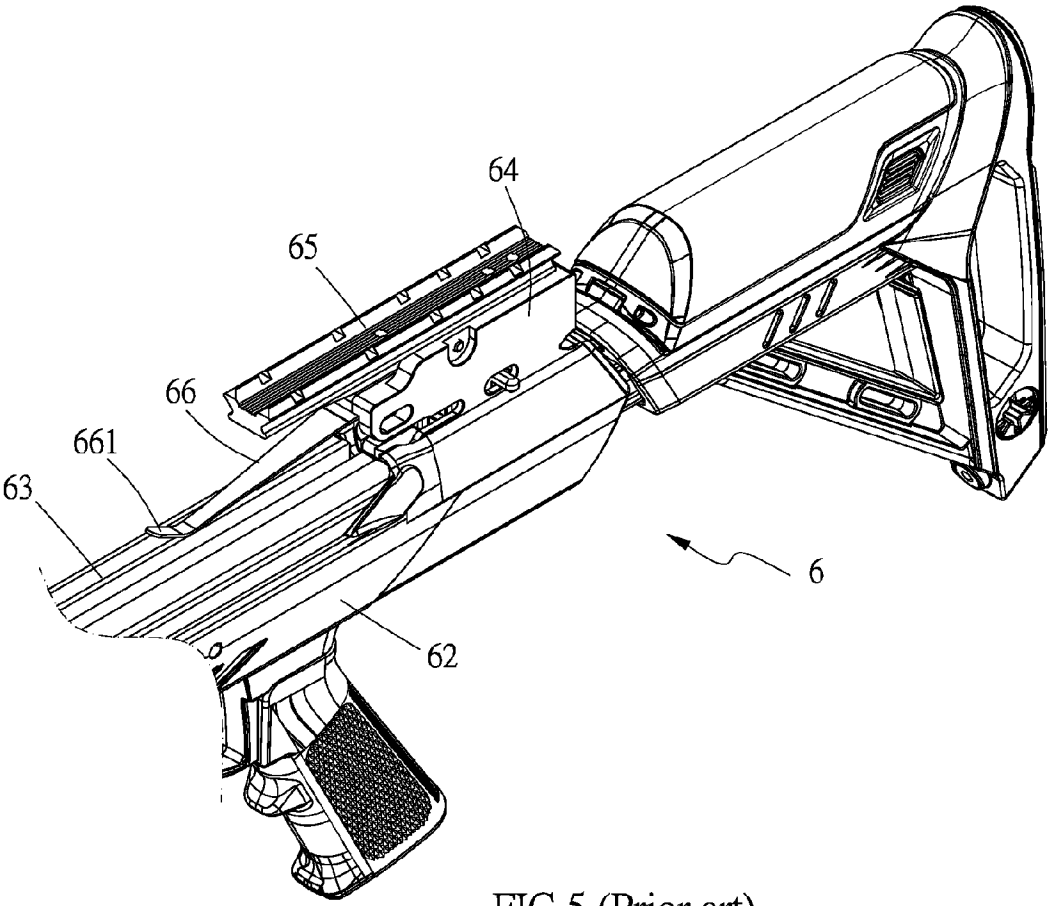
FIG.5 (Prior art)
FIG. 5 shows a portion of a conventional crossbow.
Figure 6:
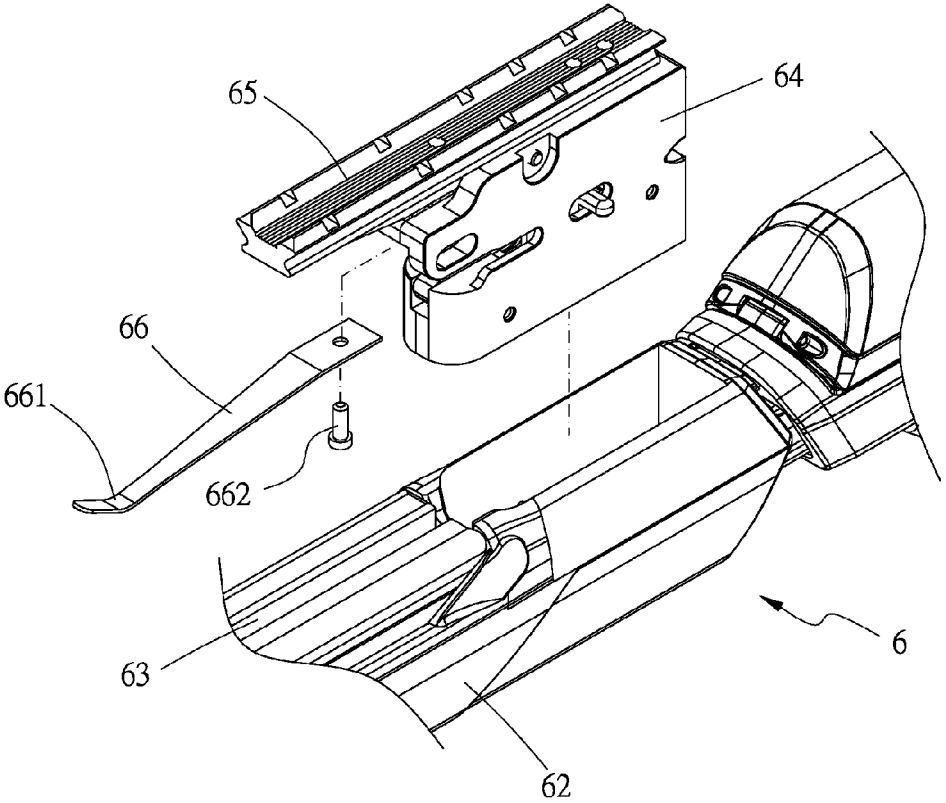
FIG.6 (Prior art)
FIG. 6 is an exploded view to show the pressing plate and the aiming device of the conventional crossbow.
Figure 7:
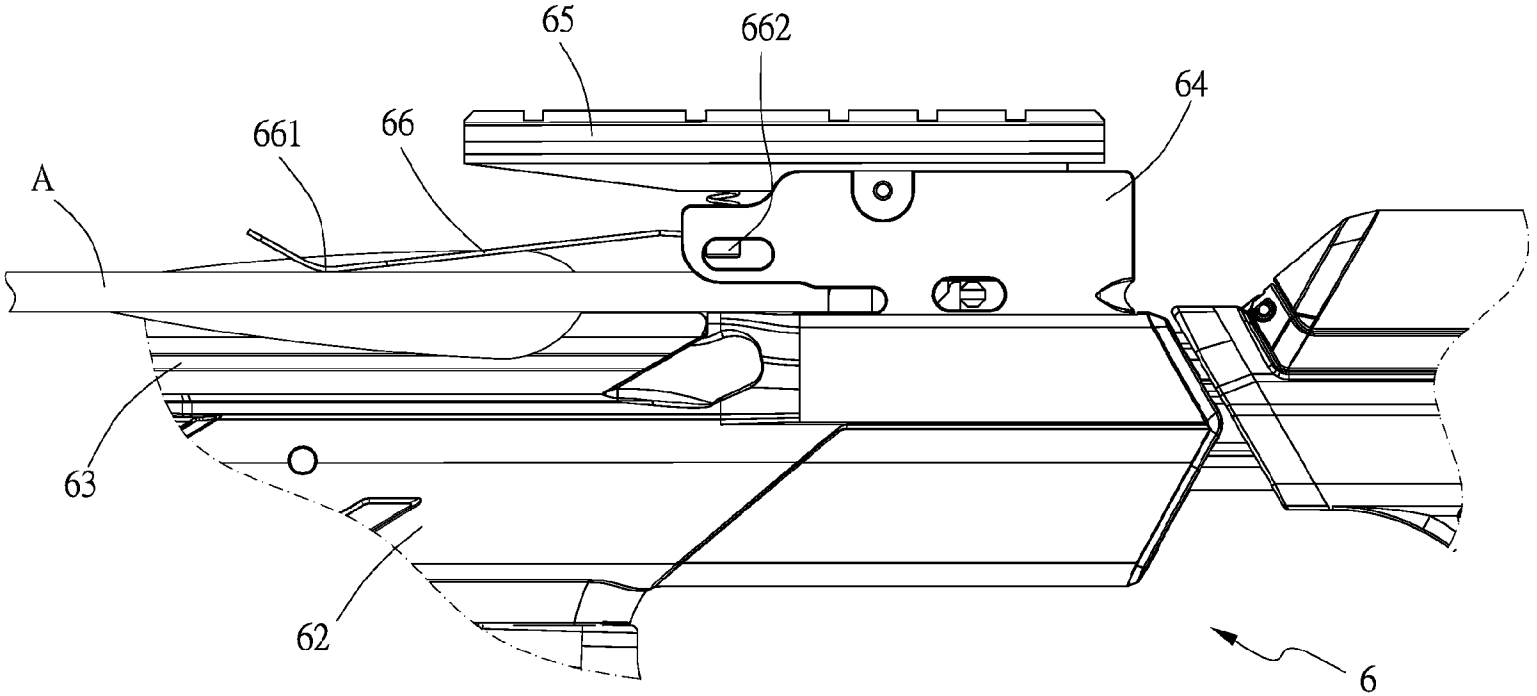
FIG.7 (Prior art)
FIG. 7 is a side view to show that the pressing plate presses the arrow shaft installed to the conventional crossbow.

As shown in FIG. 3, the arrow shaft pressing device of the present invention is composed of the sleeve 2, the pressing member 3, the resilient member 4 and the restriction member 5. The sleeve 2 is threadedly connected to the aiming device 15, and the resilient member 4 is installed in the passage 21 of the sleeve 2. When replacing the resilient member 4, the sleeve 2 can be unthreaded from the threaded hole 151 of the aiming device 15, and the restriction member 5 is removed from the sleeve 2 to replace the resilient member 4 individually while no other parts such as the aiming device 15 needs to be detached from the body 1.

While we have shown and described the embodiment in accordance with the present invention, it should be clear to those skilled in the art that further embodiments may be made without departing from the scope of the present invention.

What is claimed is:

1. An arrow shaft pressing device for a crossbow which has an aiming device connected to a body of the crossbow, the arrow shaft pressing device comprising:

a sleeve having a passage defined axially therein, an aperture defined through a lower end of the sleeve and coaxially communicating with the passage, a diameter of the aperture being smaller than that of the passage so as to form a shoulder at a connection portion between the passage and the aperture, the sleeve having outer threads formed on an outside of a top end thereof, a stop extending radially from the outside of the sleeve and located below the outer threads of the sleeve, the outer threads of the sleeve being adapted to be connected to a threaded hole of the aiming device, the stop being adapted to contact an underside of the aiming device;

a pressing member having a flange and a shank extending from an underside of the flange, the pressing member located in the passage of the sleeve and a distal end of the shank extending beyond the aperture, and a restriction member connected to an inside of the top end of the sleeve, a resilient member located in the passage and biased between the flange of the pressing member and the restriction member, the distal end of the shank of the pressing member adapted to press an arrow shaft.

2. The arrow shaft pressing device as claimed in claim 1, wherein a cross sectional area of the flange of the pressing member is larger than that of the shank.

3. The arrow shaft pressing device as claimed in claim 2, wherein the inside of the top end of the sleeve has inner threads, the restriction member has outer threads which are threadedly connected to the inner threads of the sleeve.

4. The arrow shaft pressing device as claimed in claim 1, wherein the inside of the top end of the sleeve has inner threads, the restriction member has outer threads which are threadedly connected to the inner threads of the sleeve.

5. The arrow shaft pressing device as claimed in claim 1, wherein the distal end of the shank of the pressing member has a pressing portion which is a curved surface.

6. The arrow shaft pressing device as claimed in claim 5, wherein the top end of the sleeve is adapted to be connected to the aiming device by way of threading, snapping, engagement or locking.

* * * * *